US009773623B2

(12) United States Patent
Lin et al.

(10) Patent No.: US 9,773,623 B2
(45) Date of Patent: Sep. 26, 2017

(54) KEY CAP LINKAGE MECHANISM

(71) Applicant: Chicony Electronics Co., Ltd., New Taipei (TW)

(72) Inventors: Chun-Ting Lin, New Taipei (TW); Liang-Chun Yeh, New Taipei (TW); Chieh-Fan Chuang, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 15/146,904

(22) Filed: May 5, 2016

(65) Prior Publication Data

US 2017/0250035 A1 Aug. 31, 2017

(30) Foreign Application Priority Data

Feb. 25, 2016 (TW) ..... 105202654 U

(51) Int. Cl.
*H01H 13/70* (2006.01)
*H01H 3/12* (2006.01)
*H01H 13/52* (2006.01)

(52) U.S. Cl.
CPC ..... *H01H 3/122* (2013.01); *H01H 13/52* (2013.01); *H01H 13/70* (2013.01)

(58) Field of Classification Search
CPC ..... H01H 13/7065; H01H 221/058
USPC ..... 200/344, 5 A
See application file for complete search history.

(56) References Cited

U.S. PATENT DOCUMENTS 6,936,782 B2 * 8/2005 Ito ..... H01H 3/125 200/341
2015/0107979 A1 * 4/2015 Nishino ..... H01H 13/705 200/512

FOREIGN PATENT DOCUMENTS

TW M430645 U 6/2012
TW M436188 U 8/2012

* cited by examiner

*Primary Examiner* — Vanessa Girardi
(74) *Attorney, Agent, or Firm* — CKC & Partners Co., Ltd.

(57) ABSTRACT

A keyswitch structure includes a base plate, a key cap, a key base, a recovering member and a linkage mechanism having linkage members. The key base is disposed between the key cap and the base plate. The recovering member is disposed between the key cap and the base plate. The linkage members are physically separated from each other, and are respectively inclinedly disposed between the key base and the key cap, and collectively surround the recovering member. One end of each of the linkage members is pivotally connected to the key base, and the other end of each of the linkage members is slidably connected to the key cap.

14 Claims, 9 Drawing Sheets

KEY CAP LINKAGE MECHANISM

RELATED APPLICATIONS

This application claims priority to Taiwan Application Serial Number 105202654, filed Feb. 25, 2016, which is herein incorporated by reference.

BACKGROUND

Field of Disclosure

The present disclosure relates to a keyswitch structure.

Description of Related Art

Keyboards are common input devices for a wide variety of electronic devices (e.g., desktop computers, laptops, smart phones or tablet PCs, etc.). In a conventional keyboard, a keyswitch structure is provided thereon, and the keyswitch structure includes a key cap and a linkage mechanism, and the linkage mechanism is connected between the key cap and a base plate for vertically moving the key cap.

However, there still exist technical issues to be overcome regarding the structural strength of the conventional keyboard. For example, a method of assembling the linkage mechanism with the key cap is relatively complicated, and thus the linkage mechanism has a certain degree of difficulty to be disassembled from the key cap for maintenance; and when the keyboard is pressed, the pressing force of a user cannot be evenly distributed to the corners of the key cap, thus failing to trigger the keyboard properly after the keyboard is pressed. Furthermore, because the linkage mechanism of the conventional keyboard is fragile, it is often broken in use.

Therefore, how to effectively overcome the aforementioned inconvenience and shortages is seriously concerned by the industries.

SUMMARY

An aspect of the disclosure is to provide a keyswitch structure to overcome the defects and inconvenience of the prior art, in which, when the keyswitch structure is in maintenance or replacement, the possibility of the key cap unexpectedly detached from the linkage mechanism is reduced by providing a greater structural strength between a linkage mechanism and a key cap of the keyswitch structure.

According to one embodiment, the keyswitch structure includes a base plate, a key cap, a key base, a recovering member and a linkage mechanism having linkage members. The key base is disposed between the key cap and the base plate. The recovering member is disposed between the key cap and the base plate. The linkage members are separated from each other, respectively inclinedly disposed between the key base and the key cap, and collectively surround the recovering member. Each of the linkage members is pivotally connected to the key base at one end thereof, and is slidably connected to the key cap at the other end thereof, thereby moving along with the vertical movement of the key cap. Also, with the arrangement of the linkage members and the key cap, the force pressing the key cap can be evenly distributed on the key cap so as to decrease the possibilities of improperly triggering the keyswitch structure as the key cap is shaken and tilted.

Therefore, in this embodiment, when the key cap is removed, the linkage members can be disassembled from the key base together, so that the linkage members can be replaced conveniently, and the possibilities that only the key cap is removed, and that the linkage member is damaged in the complicated disassembling process can be reduced.

Furthermore, in this embodiment, since the linkage members are connected to the key base, rather than to the base plate, all of the linking movements of the linkage mechanism occur above the base plate, and thus the circuit board in the keyswitch structure does not need too many holes, such that the damages to the circuit board due to dust or water penetration are decreased.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
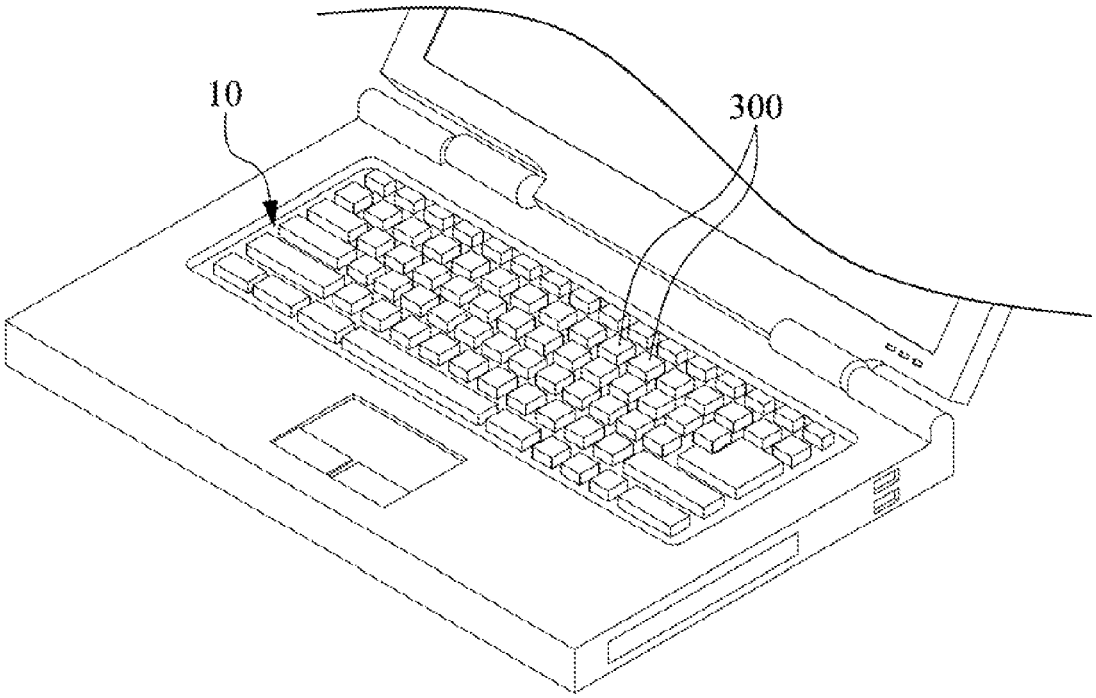
FIG. 1 is a schematic perspective view of a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the present disclosure without departing from the scope or spirit of the disclosure.

Figure 2:
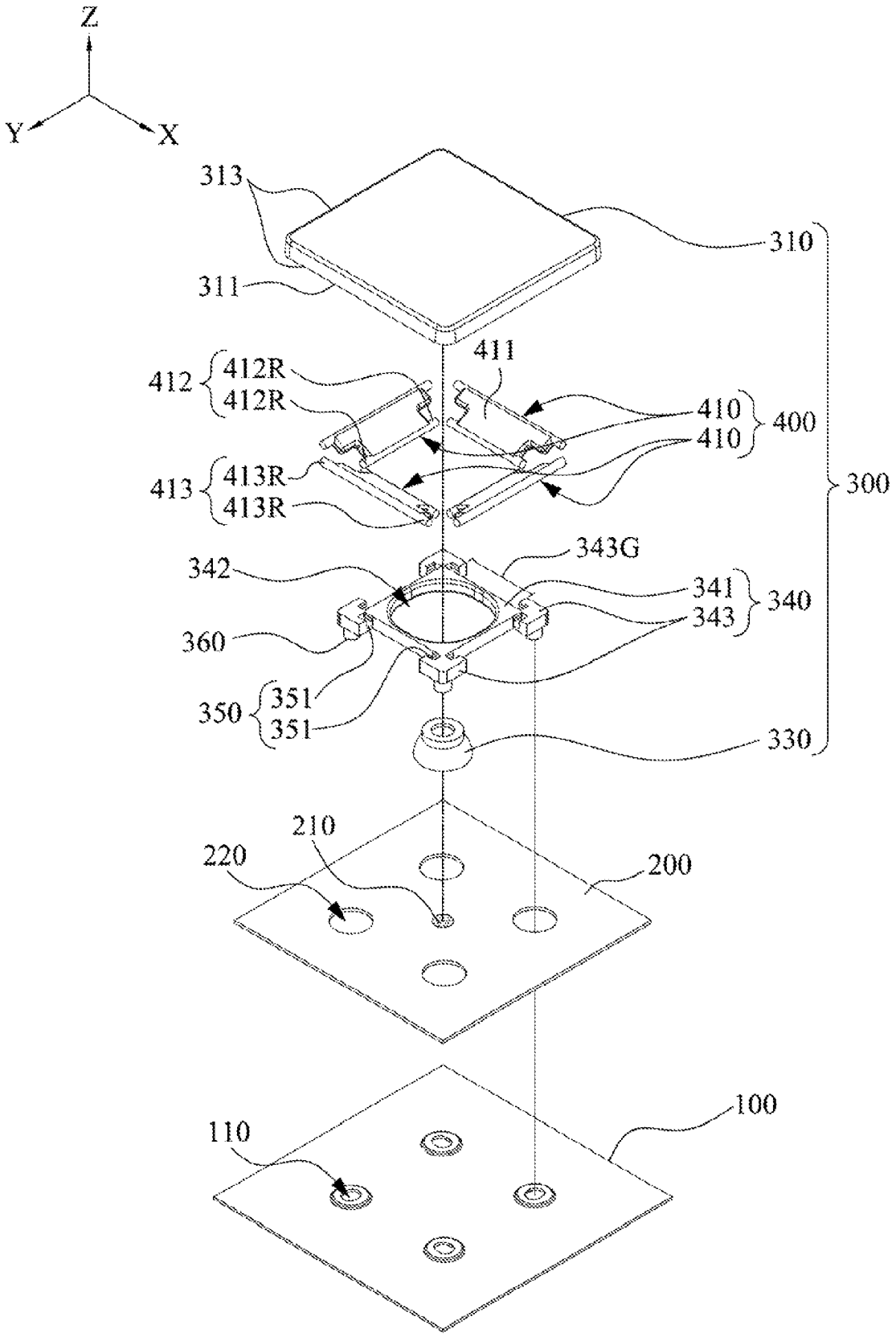
FIG. 2 is an exploded view of the keyswitch structure of FIG. 1.

Reference is now made to FIG. 1 and FIG. 2, in which FIG. 1 is a schematic perspective view of a keyboard 10 according to an embodiment of the disclosure, and FIG. 2 is an exploded view of the keyswitch structure 300 of FIG. 1. As shown in FIG. 1 together with FIG. 2, the disclosure provides a keyswitch structure 300 and a keyboard 10 having the keyswitch structure 300. The keyboard 10 includes a base plate 100, a circuit board 200 (e.g., a thin film circuit board) and keyswitch structures 300. The circuit board 200 is stacked on the base plate 100, and the keyswitch structures 300 are arranged at intervals on the circuit board 200. However, in the disclosure, the keyswitch structures 300 are not necessarily limited to being disposed on the base plate 100 and the circuit board 200.

Figure 3:
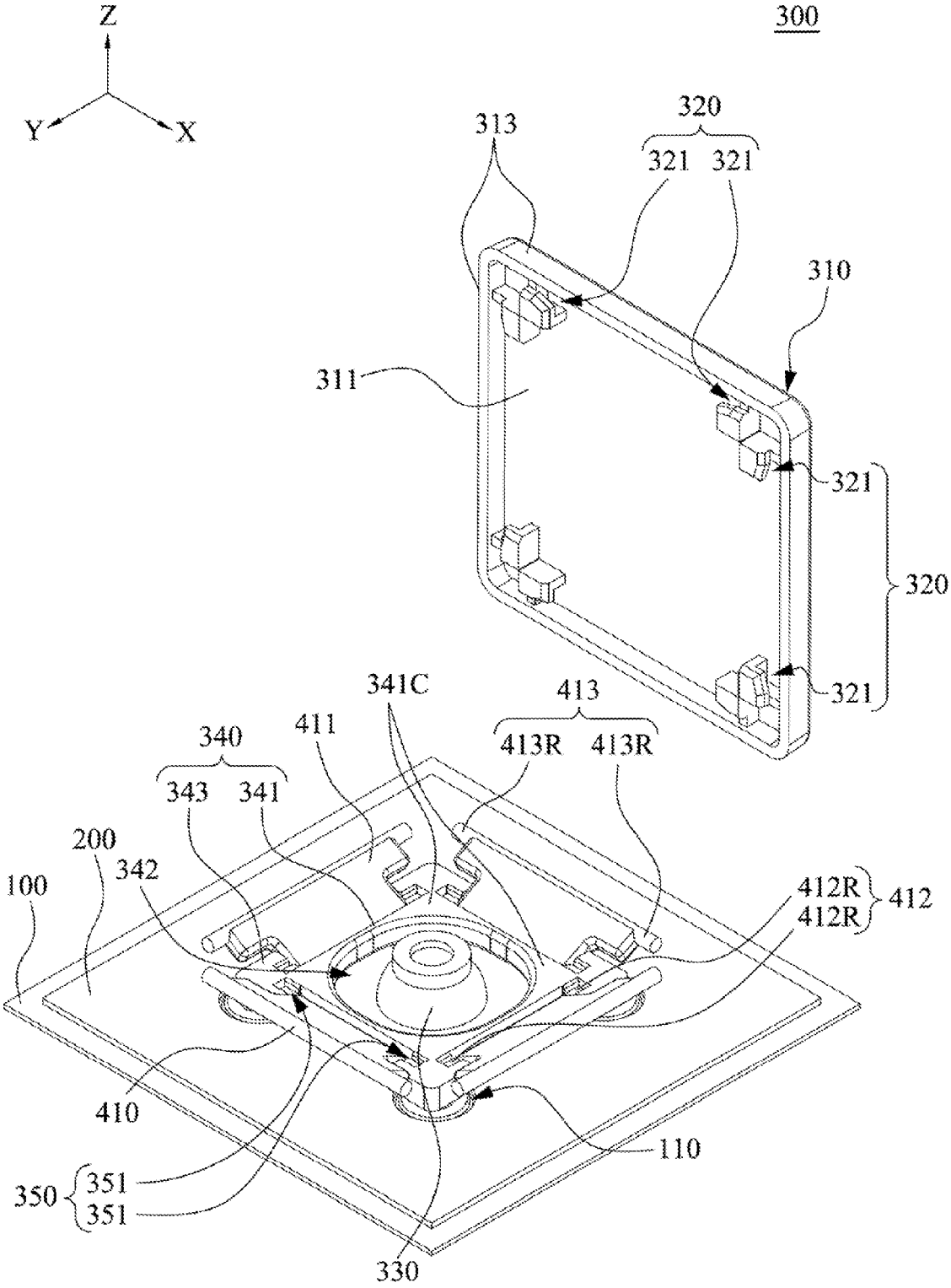
FIG. 3 is a partially assembled view of FIG. 2.

As shown in FIG. 2 together with FIG. 3, each of the keyswitch structures 300 includes a key cap 310, a recovering member 330, a key base 340, and a linkage mechanism 400. The key cap 310 covers the recovering member 330, the key base 340, and the linkage mechanism 400. The key base 340 is fixedly connected to the base plate 100 through the circuit board 200, and the circuit board 200 is sandwiched between the base plate 100 and the key base 340. Also, the key base 340 is formed with an opening 342 thereon. The recovering member 330 is arranged in the opening 342, and the recovering member 330 is disposed between the key cap 310 and the base plate 100. The recovering member 330 is sandwiched between the key cap 310 and the circuit board 200, and the recovering member 330 is used for supporting the key cap 310, and providing an elastic force to restore the key cap 310 back to the original position. The recovering member 330 in the embodiment is, for example, a rubber elastic body. However, since the installations of the recovering member and the circuit board are common technical knowledge in the field of keyboards, the disclosure does not repeat hereinafter. Other installations of the recovering member and the circuit board which are not limited in the disclosure also can be adopted in the disclosure. The linkage mechanism 400 includes a plurality of linkage members 410. The linkage members 410 are completely independent to each other, and the linkage members 410 are physically separated from each other. The linkage members 410 are respectively inclinedly disposed between the key base 340 and the key cap 310, and surround the recovering member 330. Each of the linkage members 410 is detachably and pivotally connected to the key base 340 at one end thereof, and is slidably connected to the key cap 310 at the other end thereof, thus, the linkage members 410 are used for guiding the key cap 310 to vertically move relative to the base plate 100 in a specific routine. With the arrangement of the linkage members and the key cap, the force for pressing against the key cap by a user can be evenly distributed on the key cap 310.

Specifically, as shown in FIG. 2 and FIG. 3, the key cap 310 includes a plurality of sliding slot portions 320. The sliding slot portions 320 are disposed on a bottom surface of the key cap 310. The key base 340 includes a plurality of fastening recess portions 350. Each of the linkage members 410 includes a plate body 411, a pivoting portion 412 and a sliding portion 413. The pivoting portion 412 and the sliding portion 413 are respectively disposed on two opposite ends of the plate body 411. The pivoting portion 412 is pivotally connected to one of the fastening recess portions 350. In this embodiment, the pivoting portion 412 is detachably and pivotally connected to one of the fastening recess portions 350, however, the disclosure is not limited thereto. The sliding portion 413 is slidably connected to one of the sliding slot portions 320. Each of the fastening recess portions 350 includes two pivotal grooves 351. Each of the pivoting portion 412 includes two first pivotal shafts 412R which extend towards two opposite directions. Each of the first pivotal shafts 412R is pivotally connected in the corresponding pivotal grooves 351. Each of the sliding slot portions 320 includes two slot openings 321 which are separated from each other. Each of the sliding portions 413 includes two second pivotal shafts 413R which extend towards two opposite directions. Each of the second pivotal shafts 413R is slidably connected in the corresponding slat opening 321.

Therefore, in this embodiment, comparing to the connection of the linkage mechanism 400 and the key cap 310, since the linkage mechanism 400 is detachably connected to the key base 340, thus, when the key cap 310 is pulled out from the key base 340, the linkage mechanism 400 is easier to be removed from the key base 340 along with the key cap 310 for replacement of damaged elements. Thus, the possibilities that only the key cap 310 is detached from the key base 340 or one of the linkage members 410 is damaged due to the complicated procedure of removing the linkage mechanism can be decreased.

Also, since each of the linkage members 410 is slab-shaped, the linkage mechanism 400 is provided with higher structural strength so as to be advantageous in miniaturization design of the keyswitch structure and improvement of the durability of the keyswitch structure. Furthermore, because the linkage members 410 are independently formed and physically separated from each other, comparing to the traditional keyswitch structure (e.g., scissor type keyswitch), when the linkage mechanism 400 is damaged, any of the damaged linkage members 410 can be changed individually, so that the complicated assembly and disassembly are not further needed. Thus, the procedure cost of the maintenance can be decreased.

In great details, as shown in FIG. 2, the size of the key cap 310 is greater than the size of the key base 340, and the key cap 310 covers the recovering member 330, the key base 340 and the linkage mechanism 400. The key cap 310 includes a bottom surface 311 and a plurality of side portions 313. The side portions 313 surround and adjoin the bottom surface 311. Each of the sliding slot portions 320 is disposed on an area of the bottom surface 311 neighboring to one of the side portions 313, specifically, each of the sliding slot portions 320 is connected to the bottom surface 311, one of the side portions 313 and another neighboring one of the sliding slot portions 320. Thus, since each of the slot openings 321 of the sliding slot portions 320 is arranged to close to one junction of every two neighboring side portions 313 as much as possible, the size of each of the linkage members 410 which corresponds to one of the sliding slot portion 320 is therefore enlarged, so that the linkage members 410 can stably guide the key cap 310 to vertically move. Furthermore, each of the sliding slot portions 320 connected to the linkage mechanism 400 is disposed on the bottom surface 311 neighboring to each side portion 313 and being close to another sliding slot portion 320, that is, each of the linkage members 410 is respectively slidably connected to an area of the key cap 310 neighboring to one of peripheral edges of the key cap 310, and any two neighboring ones of the linkage members 410 are connected to one of corners of the key cap 310. Thus, it is advantageous to evenly distribute the force pressed by a user on the corners of the key cap 310 to everywhere of the key cap 310 so as to further stably guide the key cap 310 to vertical move, decrease the possibilities of improperly triggering the keyswitch structure as the key cap is shaken and tilted thereby increasing the smoothness and sensitivity of the keyswitch structure 300.

The key base 340 includes a block body 341 and plural external attached portions 343 (such as four external attached portions). The opening 342 passes through the block body 341 for receiving the recovering member 330. In the disclosure, the opening 342 is not limited to a through hole or a blind hole. The external attached portions 343 are respectively arranged at intervals on peripheral edges of the block body 341, and the external attached portions 343 are respectively connected to the block body 341 integrally. In an example to which the disclosure is not limited, the block body 341 is a rectangular column with four edge-corners 341C. The external attached portions 343 are respectively formed on the edge-corners 341C of the rectangular column. The fastening recess portions 350 are respectively disposed on the external attached portions. Each of the external attached portions 343 is formed with two pivotal grooves 351 each of which has one of two different fastening recess portions 350, so as to respectively receive two first pivotal shafts 412R of the two different the pivoting portions 412.

The key base 340 is further provided with fixing rods 360. The fixing rods 360 are disposed on a bottom of the key base 340 for fixing the key base 340 on the base plate 100. For example, each of the fixing rods 360 protrudes from one surface of each of the external attached portions 343 facing towards the circuit board 200. Thus, when the fixing rods 360 are respectively inserted into corresponding holes 110 of the base plate 100 through breaking holes 220 of the circuit board 200, the key base 340 can be fixed on the base plate 100. For example, the fixing rods 360 and the corresponding holes 110 can be coupled together by hot melt bonding or engagement, but the disclosure is not limited thereto.

It is noted that, because the numbers, locations and sizes of the fixing rods 360 and the corresponding holes 110 can be adjusted correspondingly based on the requirements or restrictions, the circuit board only needs to provide breaking holes formed thereon according to the numbers, locations and sizes of the fixing rods 360 and the corresponding holes 110. Thus, the smaller numbers or sizes of the fixing rods 360 and the corresponding holes 110 help to reduce the smaller numbers or sizes of the breaking holes, thereby not only facilitating a waterproof or dustproof effect, but also reserving more available areas of the circuit board 200 for circuit layout or grounding.

It is needed to be understood that, although the number of the external attached portions 343, the number of the linkage members 410, the number of the fixing rods 360 and the number of the fastening recess portions 350 in the embodiment are the same, the number of the external attached portions 343 and the number of the fastening recess portions 350 can be adjusted correspondingly in accordance with the number of the linkage members 410. However, the disclosure is not limited to that the number of the external attached portions, the number of the linkage members, the number of the fixing rods and the number of the sliding slot portions have to be equal, one skilled in the art of the disclosure may flexibly adjust the number of the external attached portions, the number of the linkage members, the number of the fixing rods and the number of the sliding slot portions according to the actual requirements.

Figure 4A:
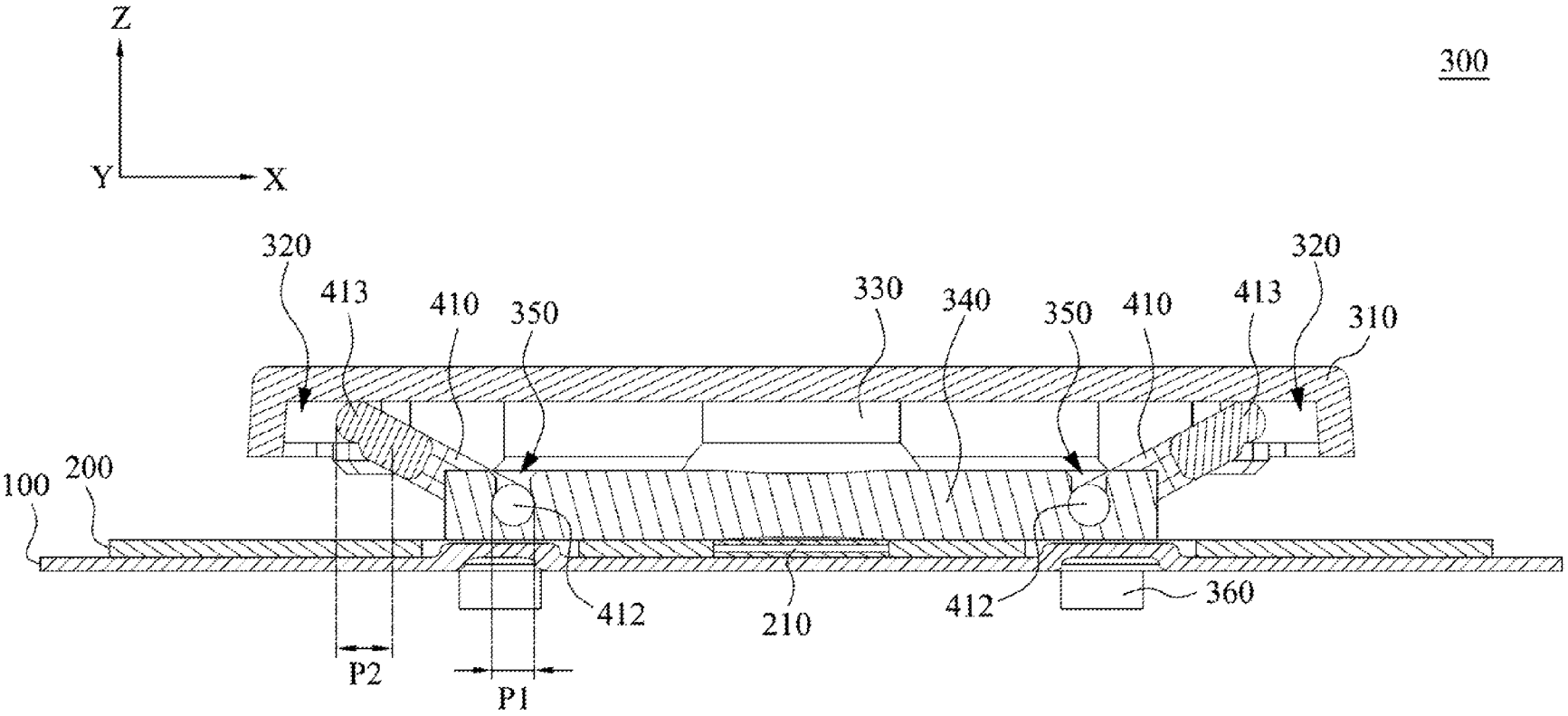
FIG. 4A-FIG. 4B are schematic operational views of the keyswitch structure of FIG. 2.
Figure 4B:
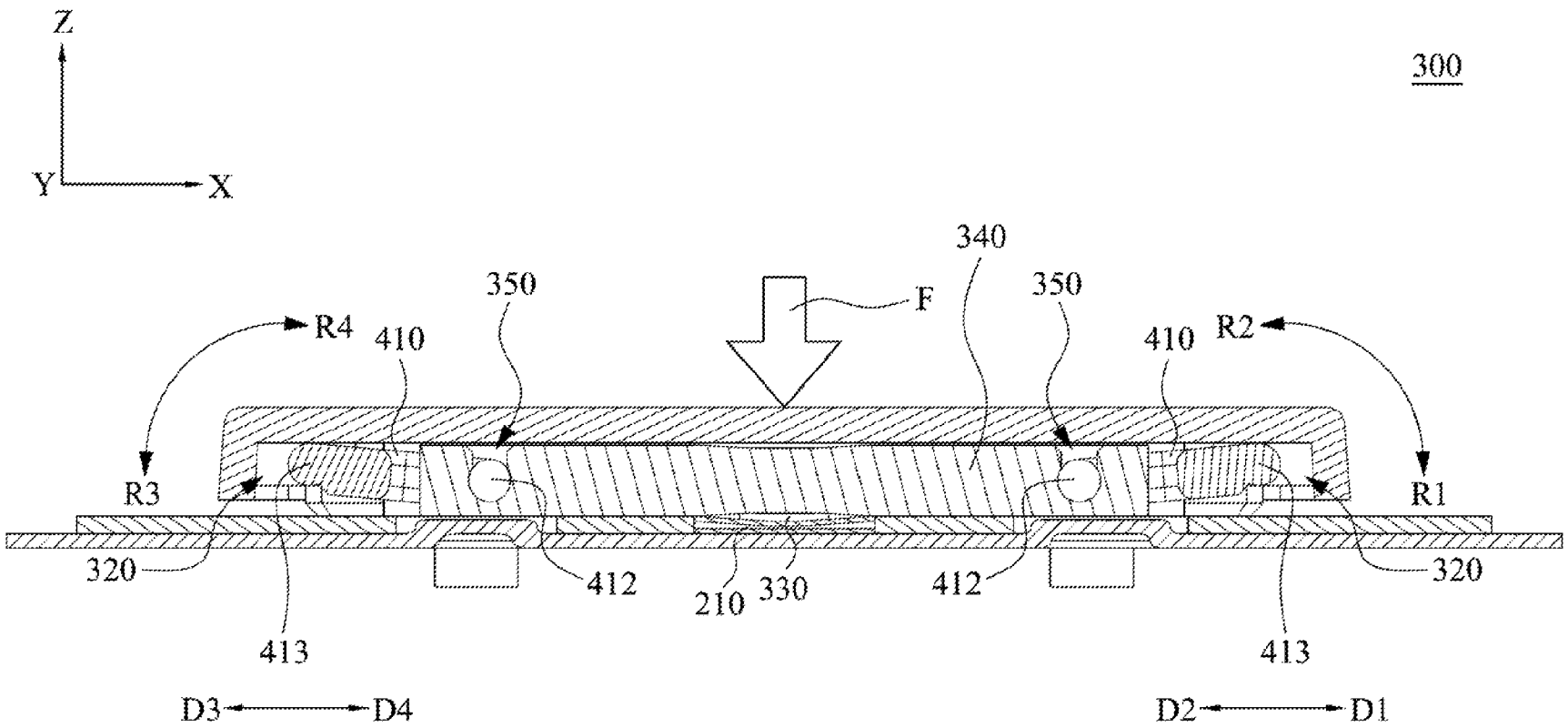

FIG. 4A and FIG. 4B are schematic operational views of the keyswitch structure 300 of FIG. 2. As shown in FIG. 4A and FIG. 4B, when a pressing force F presses down the key cap 310 and the recovering member 330, with the descending of the key cap 310, one end (e.g., pivoting portion 412) of each of the two linkage members 410 shown in the FIG. 4B is rotated from the direction R2 or R4 towards the direction R1 or R3 that is far away from the recovering member 330, and the other end (e.g., sliding portion 413) of each of the two linkage members 410 shown in the FIG. 4B slides on the key cap 310 from the direction D2 or D4 towards the direction D1 or D3 that is far away from the recovering member 330, and finally, the recovering member 330 contacts and triggers the switch circuit 210 of the circuit board 200 to output triggered signals.

Furthermore, referring back to FIG. 2 again, a gap 343G is defined between any two neighboring ones of the external attached portions 343. A width of the gap 343G is not smaller than a width of one of the linkage members 410. Therefore, when the key cap 310 is pressed down, each of the linkage members 410 enters into one of the gaps 343G of the external attached portions 343, rather than being interfered by the external attached portions 343.

On the other hand, as shown in FIG. 4A, after the pressing force F is relieved, the recovering member 330 is elastically recovered and pushes the key cap 310 back to the previous position, so as to link the linkage members 410 along with the key cap 310. At this moment, with the ascending of the key cap 310, the end (e.g., pivoting portion 412) of each of the two linkage members 410 shown in the FIG. 4A is rotated from the direction R1 or R3 towards the direction R2 or R4 approaching to the recovering member 330, and the other end (e.g., sliding portion 413) of each of the two linkage members 410 shown in the FIG. 4A is slid on the key cap 310 from the direction D1 or D3 towards the direction D2 or D4 approaching to the recovering member 330, thus completing one pressing stroke of the keyswitch structure 300.

It is needed to understood that, referring to FIG. 4A, since each of the linkage members 410 is pivotally connected to the top of the key base 340, rather than to the bottom of the key base 340 facing towards the circuit board 200. Since the linkage members 410 does not physically contact the circuit board 200, abrasion will not be caused on the circuit board 200 by the linkage members 410, thus decreasing the damage on the circuit board 200.

As shown in FIG. 3 and FIG. 4A, since all of the sliding portion 413 are arranged outside the key base 340, relative to all of the pivoting portions 412, each of the linkage members 410 is respectively inclinedly disposed between the key base 340 and the key cap 310 in relative to Z axis. For example, since an orthographic projection P1 of the pivoting portions 412 projected onto one plane (e.g., one surface of the circuit board 200) is arranged between the opening 342 and an orthographic projection P2 of the sliding portion 413 projected onto the same plane (e.g., the surface of the circuit board 200), each of the linkage members 410 is gradually inclined from the key base 340 to the key cap 310 towards a direction that is far away from the recovering member 330.

Also, the dimensions of the linkage members 410 are the same, and the linkage members 410 are collectively surround the block body 341, and the linkage members 410 are arranged individually on four peripheral edges of the block body 341. In other words, each of the peripheral edges of the block body 341 is connected to a single one of the linkage members 410, and thus the four linkage members 410 can be reciprocally linked along with the vertical movements of the key cap 310.

Figure 5:
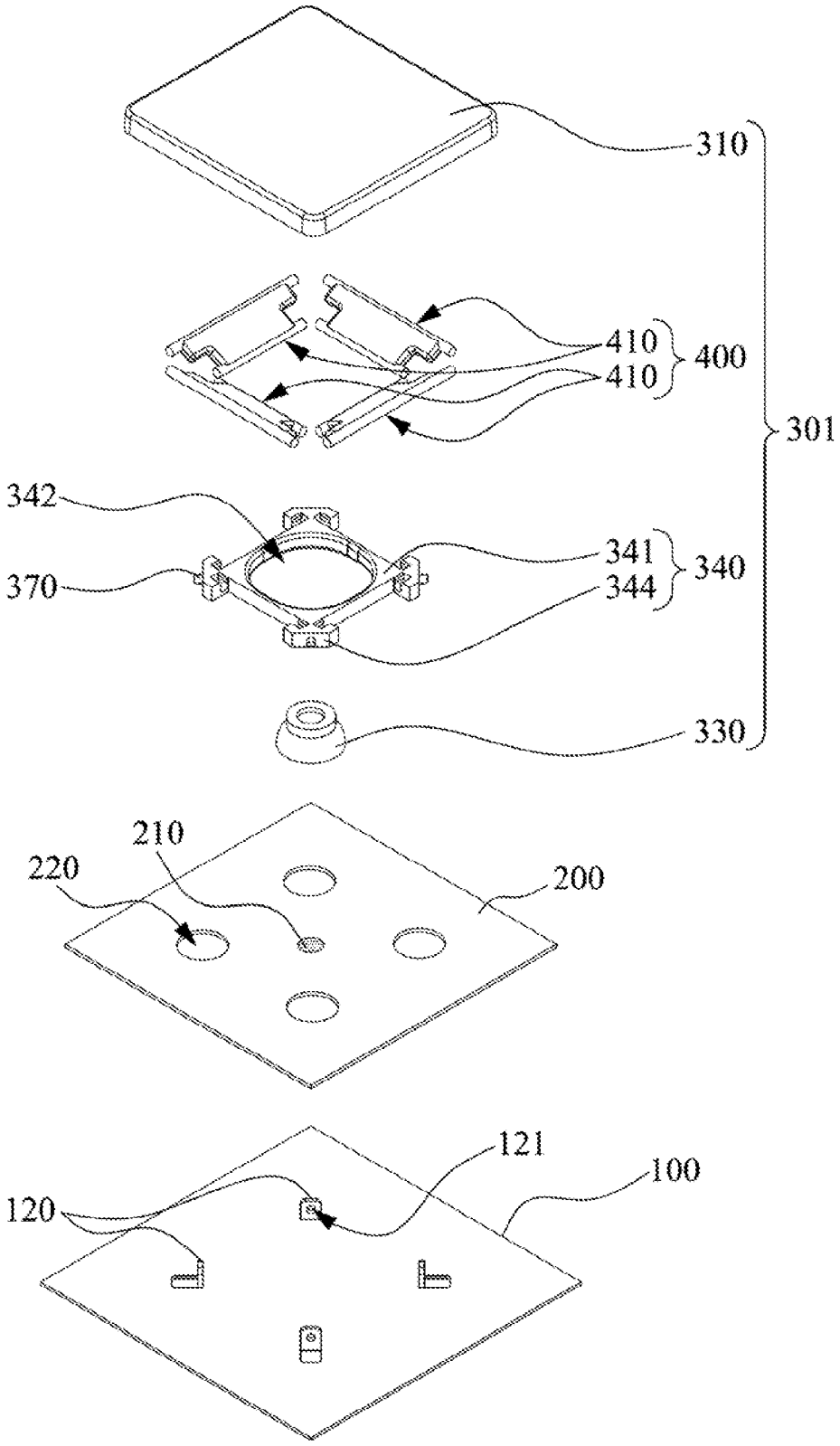
FIG. 5 is an exploded view of a keyswitch structure according to another embodiment of the disclosure.
Figure 6:
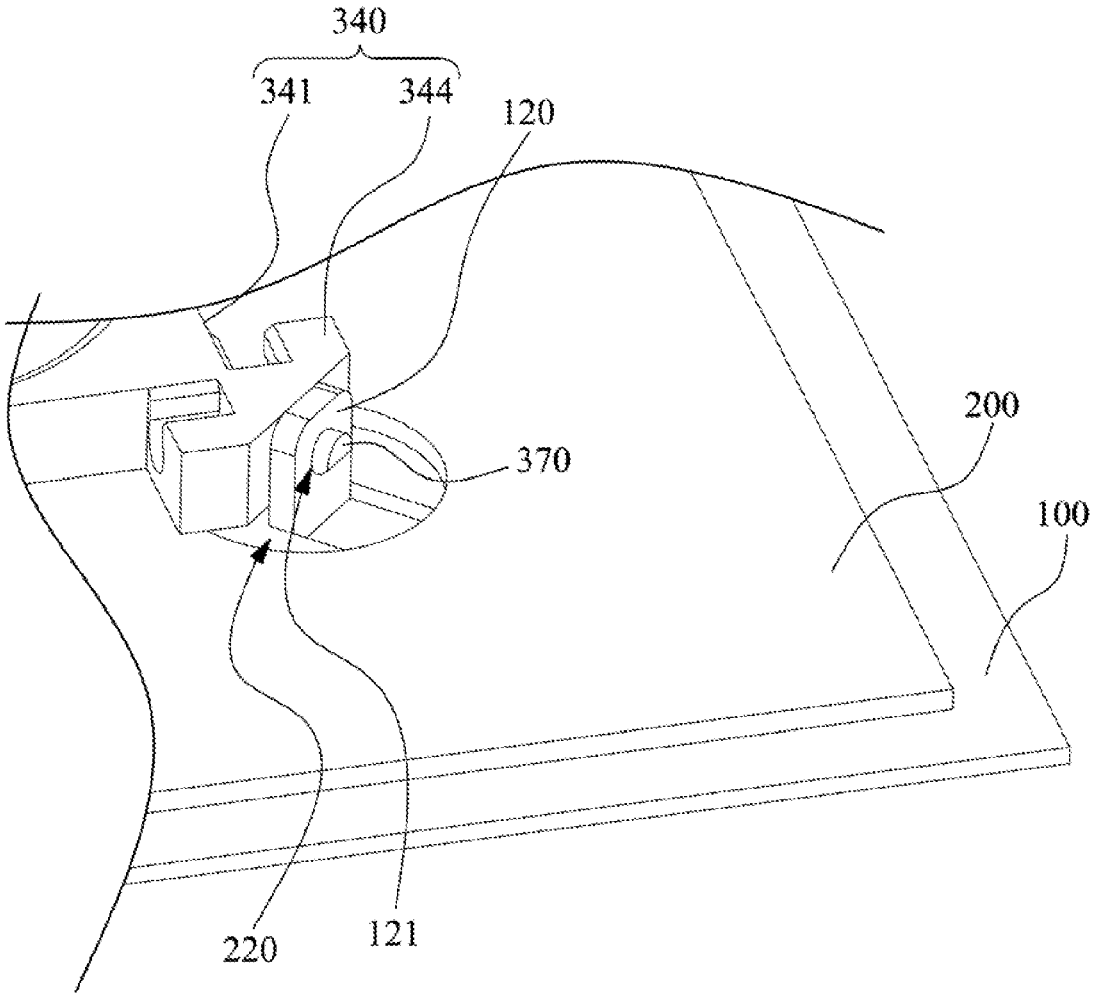
FIG. 6 is a partially enlarged assembled view of FIG. 5.

Reference is now made to FIG. 5 and FIG. 6 in which FIG. 5 is an exploded view of a keyswitch structure 301 according to another embodiment of the disclosure, and FIG. 6 is a partially enlarged assembled view of FIG. 5. As shown in FIG. 5 and FIG. 6, the keyswitch structure 301 of FIG. 5 is substantially the same as the keyswitch structure 300 of FIG. 2, except that the key base 340 is further provided with fastening ribs 370 instead of the fixing rods of FIG. 2, and the fastening ribs 370 horizontally extend outwards from the key base 340. The base plate 100 is provided with fastening portions 120 respectively extending upwardly.

For example, the fastening ribs 370 respectively protrude from outer surfaces of each of the external attached portions 344 that are away from the block body 341, and the fastening ribs 370 are located between the top and the bottom of the key base 340. The fastening portions 120 are respectively located at the base plate 100 aligned with the external attached portions 344. Each of the fastening portions 120 is formed as a part of the base plate 100 being stamped and folded upwards on a surface of the base plate 100, and each of the fastening portions 120 is provided with a fastening hole 121. Therefore, when the fastening portions 120 respectively extend through the breaking holes 220 of the circuit board 200, and the fastening ribs 370 are respectively engaged with the fastening holes 121 of the fastening portions 120, the key base 340 can be fixed on the base plate 100.

For example, the fastening ribs 370 and the corresponding fastening holes 121 can be coupled together by hot melt bonding or engagement, but the disclosure is not limited thereto. Since the height of each of the fastening portions 120 is substantially same as the thickness of the key base 340, the original thickness of the keyswitch structure will not be increased additionally so as to be advantageous to miniaturization design of the keyswitch structure.

Figure 7:
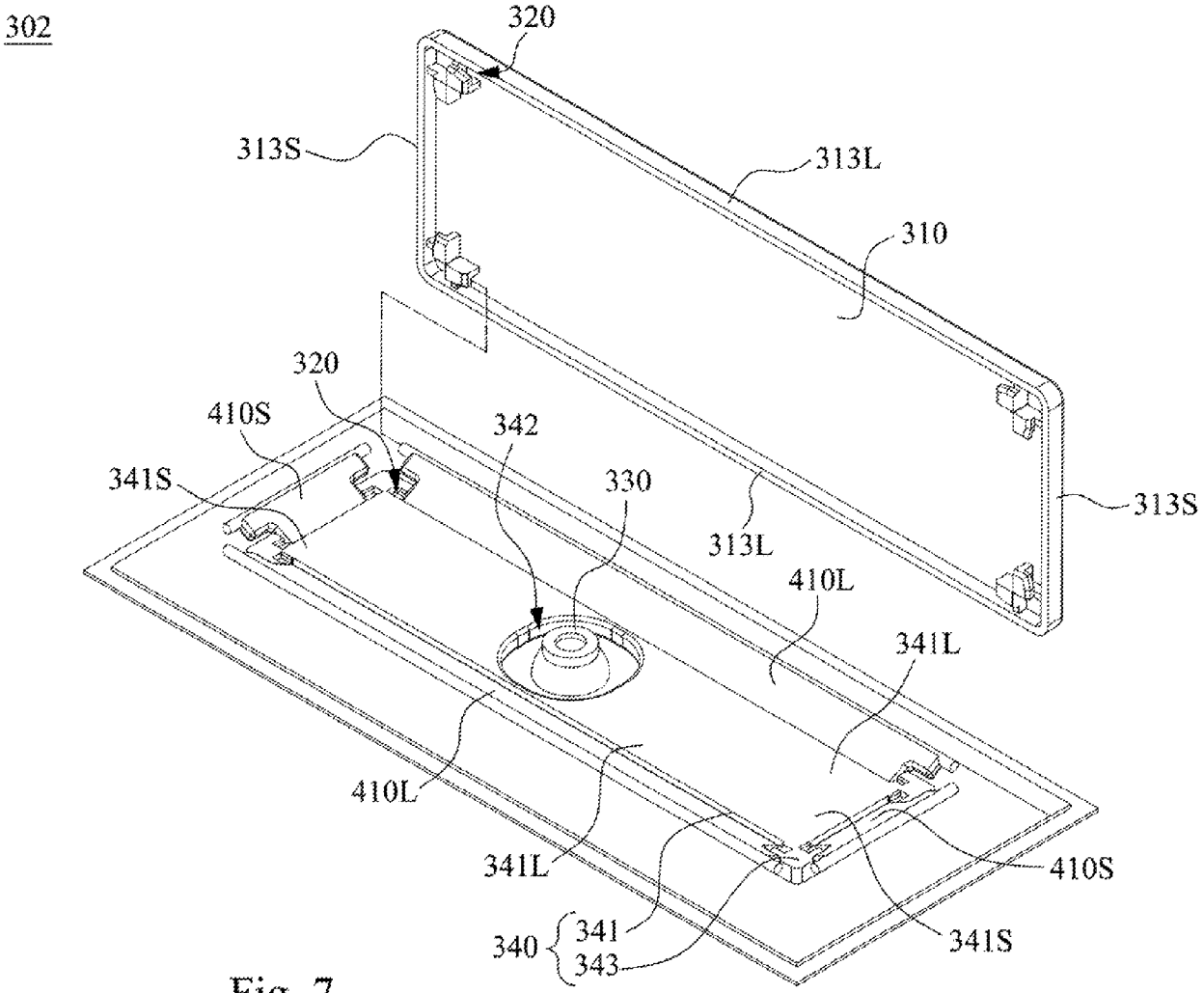
FIG. 7 is a partially assembled view of a keyswitch structure according to one another embodiment of the disclosure.

FIG. 7 is a partially assembled view of a keyswitch structure 302 according to one another embodiment of the disclosure. As shown in FIG. 7, the keyswitch structure 302 of FIG. 7 is substantially the same as the keyswitch structure 300 of FIG. 3, except that the key cap and the block body 341 are substantially formed in a rectangular shape, respectively, and all of the linkage members are not the same in size. For instance, these linkage members can be divided as two longer linkage members 410L and two shorter linkage members 410S. The longer linkage members 410L and the shorter linkage members 410S collectively surround the block body 341 of the key base 340.

In detail, each of the long linkage members 410L is connected to one of longer-side portions 313L of the key cap 310 and one of longer-side portions 341L of the key base 340, respectively. Each of the shorter linkage members 410S is connected to one of shorter-side portions 313S of the key cap 310 and one of shorter-side portions 341S of the key base 340, respectively. In other words, each of the longer-side portions 341L or each of the shorter-side portions 341S of the key base 340 is still connected to only one linkage members (i.e., long linkage member 410L or short linkage member 410S).

Thus, although the key cap 310 is formed in a rectangular shape, yet, because the bigger linkage member (e.g., longer linkage member 410L) is advantageous to distributing the pressing force on the key cap 310, and the longer linkage members 410L and the shorter linkage members 410S uniformly support the peripheral edges of the key cap 310, the smoothness and sensitivity of the keyswitch structure 302 will not be decreased, and the user friendliness will not be reduced.

Figure 8:
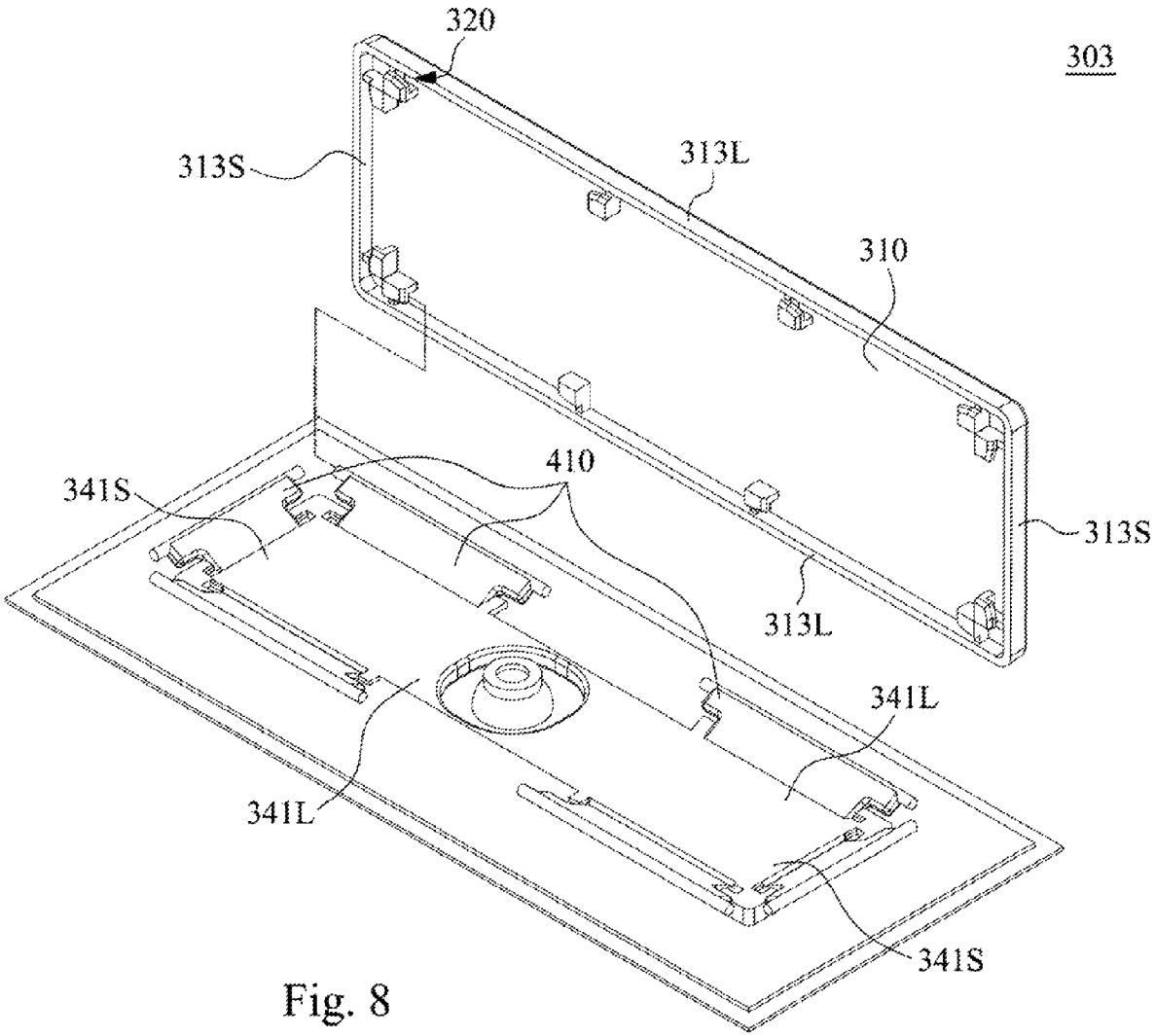
FIG. 8 is a partially assembled view of a keyswitch structure according to still another embodiment of the disclosure.

FIG. 8 is a partially assembled view of a keyswitch structure 303 according to still another embodiment of the disclosure. As shown in FIG. 8, the keyswitch structure 303 of FIG. 8 is substantially the same as the keyswitch structure 302 of FIG. 7, except that all of the linkage members 410 are the same in size, and at least two of the linkage members 410 are connected to the same side portions (e.g., longer-side portion 341L) of the block body 341. Specifically, two linkage members 410 are sequentially disposed on the same longer-side portion 341L, and only one linkage member 410 is disposed on the same shorter-side portion 341S.

It is needed to understood that the quantities of these elements described above are merely described for illustration but do not intend to limit the disclosure, one skilled in the art may flexibly adjust the quantities of the elements described above according to the actual requirements.

To sum up, the keyboard described in all of the above embodiments can be a keyboard of a notebook computer, but the disclosure is not limited thereto. In other embodiments, the keyboard also may be an individual keyboard. In addition, although the keyswitch structure is implemented on the keyboard in the aforementioned embodiments, but the disclosure is not limited to the keyswitch structure of the keyboard necessary. In other embodiments, the keyswitch structure also may be a keyswitch structure disposed on any device.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A keyswitch structure, comprising:

a key cap having a plurality of peripheral edges, and any two neighboring ones of the peripheral edges form a corner;

a base plate;

a key base disposed between the key cap and the base plate;

a recovering member disposed between the key cap and the base plate; and a linkage mechanism comprising a plurality of linkage members physically separated from each other, wherein the linkage members are inclinedly disposed between the key base and the key cap respectively, and collectively surround the recovering member, each of the linkage members is slidably connected to an area of the key cap neighboring to one of the peripheral edges of the key cap, and any two neighboring ones of the linkage members are connected to one of the corners of the key cap, wherein one end of each of the linkage members is pivotally connected to the key base, and the other end of each of the linkage members is slidably connected to the key cap for moving with the key cap.

2. The keyswitch structure of claim 1, wherein the key cap comprises a plurality of sliding slot portions, and the key base comprises a plurality of fastening recess portions; and each of the linkage members comprises a pivoting portion and a sliding portion, wherein the pivoting portion is pivotally connected to one of the fastening recess portions, and the sliding portion is slidably connected to one of the sliding slot portions.

3. The keyswitch structure of claim 2, wherein each of the linkage members further comprises a plate body, wherein the pivoting portion and the sliding portion are respectively disposed on two opposite ends of the plate body.

4. The keyswitch structure of claim 2, wherein the linkage members collectively surround the key base, and the key base is provided with a plurality of longer-side portions and a plurality of shorter-side portions, wherein at least two of the linkage members are connected to one of the longer-side portions.

5. The keyswitch structure of claim 2, wherein the key cap comprises a bottom surface and a plurality of side portions that surround and adjoin the bottom surface, wherein one of the sliding slot portions connects to the bottom surface, one of the side portions and another of the sliding slot portions.

6. The keyswitch structure of claim 5, wherein each of the sliding portions comprises two second pivotal shafts which extend towards two opposite directions, each of the sliding slot portions comprises two slot openings which are separated from each other, and respectively receive the second pivotal shafts.

7. The keyswitch structure of claim 2, wherein the key base comprises a block body and a plurality of external attached portions, and the external attached portions are respectively arranged at intervals on the block body, and are respectively connected to the block body, wherein the sliding slot portions are respectively disposed on the external attached portions.

8. The keyswitch structure of claim 7, wherein the key base further comprises a plurality of fixing rods, and each of the fixing rods protrudes from one surface of each of the external attached portions facing towards the base plate.

9. The keyswitch structure of claim 8, wherein the base plate is provided with a plurality of fixing holes respectively corresponding to the fixing rods, wherein the key base is fixed on the base plate by inserting the fixing rods into the fixing holes of the base plate.

10. The keyswitch structure of claim 7, wherein the key base further comprises a plurality of fastening ribs, and each of the fastening ribs protrudes from outer surfaces of each of the external attached portions located away from the block body.

11. The keyswitch structure of claim 10, wherein the base plate is provided with a plurality of fastening portions respectively corresponding to the fastening ribs, and each of the fastening portions is provided with a fastening hole, and when the fastening ribs are engaged with the fastening holes of the fastening portions, the key base is fixed on the base plate.

12. The keyswitch structure of claim 7, wherein each of the pivoting portion comprises two first pivotal shafts which extend towards two opposite directions, and each of the fastening recess portions comprises two pivotal grooves, and the pivotal grooves are respectively disposed on two neighboring ones of the external attached portions, and respectively receive the first pivotal shafts.

13. The keyswitch structure of claim 12, wherein two neighboring ones of the pivotal grooves are disposed on the same external attached portion.

14. The keyswitch structure of claim 12, wherein the key base has an opening formed thereon, and the recovering member is arranged in the opening.

* * * * *